United States Patent [19]

Kikuchi

[11] 4,012,468

[45] Mar. 15, 1977

[54] INNER VENTURI TUBE FOR CARBURETOR

[75] Inventor: Kunio Kikuchi, Odawara, Japan

[73] Assignee: Mikuni Kogyo Kabushiki Kaisha, Tokyo, Japan

[22] Filed: Oct. 29, 1975

[21] Appl. No.: 626,893

[30] Foreign Application Priority Data

Oct. 31, 1974 Japan ..... 49-125922

[52] U.S. Cl. ..... 261/78 R; 261/DIG. 39; 261/121 A; 239/419; 239/427.3; 239/434

[51] Int. Cl.[2] ..... F02M 7/02

[58] Field of Search ..... 261/DIG. 39, 78 R, 121 A; 239/419, 427.3, 434

[56] References Cited

UNITED STATES PATENTS

| | | | |
|---|---|---|---|
| 2,328,764 | 9/1943 | Wirth | 261/DIG. 39 |
| 2,635,861 | 4/1953 | Olson | 261/41 D |
| 3,326,539 | 6/1967 | Phipps | 261/DIG. 39 |
| 3,648,988 | 3/1972 | Dibert | 261/DIG. 39 |
| 3,664,648 | 5/1972 | Seeley, Jr. | 261/DIG. 39 |
| 3,883,622 | 5/1975 | Woods | 261/DIG. 39 |

*Primary Examiner*—Tim R. Miles
*Attorney, Agent, or Firm*—Sughrue, Rothwell, Mion, Zinn & Macpeak

[57] ABSTRACT

A construction of an inner venturi constituted by pressingly inserting an inner core having a main nozzle into an outer core having a main fuel passage such that a main fuel passage and the main nozzle open to each other, forming an annular fuel well between the outer wall of said inner core and the inner wall of said outer core, and arranging an appropriate number of bleed air inlet holes for admitting air into said fuel well and an appropriate number of sub-nozzles on the circumference of said inner core for delivering fuel from the fuel well.

7 Claims, 7 Drawing Figures

FIG. 1
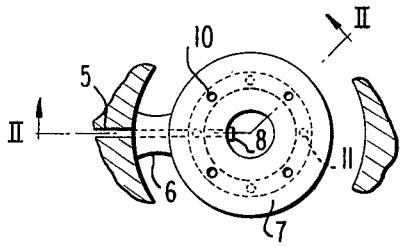
FIG. 2
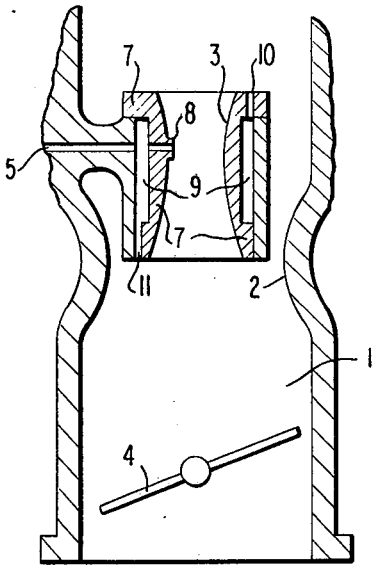
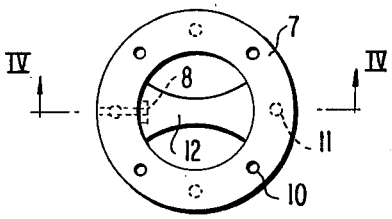
FIG. 3
FIG. 4
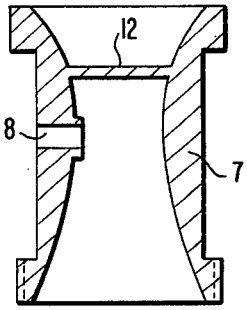
FIG. 5
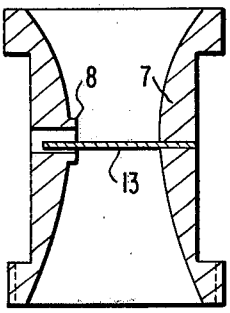
FIG. 6
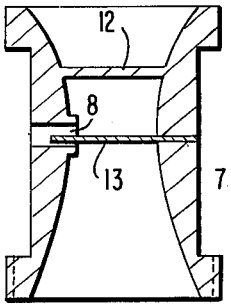
FIG. 7
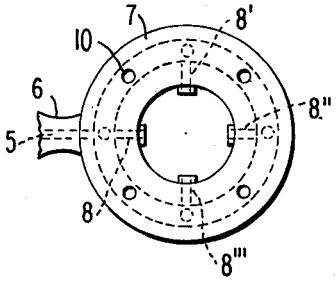

INNER VENTURI TUBE FOR CARBURETOR

BACKGROUND OF THE INVENTION

1. Field of the Invention

The present invention relates to a carburetor of the fixed venturi type, and particularly to an inner venturi tube of a carburetor.

2. Description of the Prior Art

A certain degree of fuel atomization is attained in the low output region in a slidable throttle valve type carburetor in which the venturi is variable and which is used for example in two-wheeled vehicles, or in a constant vacuum type carburetor well known as a "SU" type carburetor. However, in fixed venturi type carburetors, the air flow velocity is low at the output region where the quantity of air is small, and as a result, the negative suction pressure of the engine is small and the atomization of the fuel is not satisfactory. This poor atomization is a cause of deterioration of the mixture distribution. Accordingly, it has been common to provide a double or triple venturi, but that type of construction becomes complicated, and the size becomes larger due to an increase in the suction resistance.

SUMMARY OF THE INVENTION

A first object of the present invention is provide a venturi to obtain better atomization of the fuel.

A second object is to improve the performance of distribution, namely to improve the distribution property of fuel during the transition of the engine from slow speed to fast speed.

The further object is to eliminate the above drawbacks with a simple construction.

BRIEF DESCRIPTION OF THE DRAWINGS

FIG. 1 is a plan view showing a fixed venturi type carburetor according to the invention.

FIG. 2 shows a section through II—II in FIG. 1,

FIG. 3 is an enlarged plan view showing an embodiment of the essential part constituting the inner venturi according to the invention, FIG. 4 shows a section through IV—IV in FIG. 3, FIG. 5 is an enlarged plan view showing another embodiment of the essential part constituting the inner venturi of the present invention, FIG. 6 is an enlarged sectional view of another embodiment showing the essential parts constituting the inner venturi of the present invention, and FIG. 7 is a plan view showing a state wherein a plurality of main nozzles of the present invention are arranged.

DESCRIPTION OF THE PREFERRED EMBODIMENT

The present invention will now be described referring to the drawings. In FIGS. 1 and 2, the numeral 1 designates a suction passage, 2 an outer venturi, 3 an inner venturi, 4 a throttle valve, and 5 a main fuel passage, which is connected via a main jet to a float chamber not shown in the drawing.

In conventional systems, the fuel which has passed the main fuel passage jets into the inner venturi as it is, and being atomized there, flows into a suction passage 1.

In this invention, the inner venturi is constituted by an inner core 7 inserted into an outer core 6. There is also provided a main nozzle 8 in said inner core 7 and an annular fuel well 9 between the outer wall of the inner core 7 and the inner wall of the outer core 6. The main fuel passage 5 and the main nozzle 8 open into said fuel well 9 and an appropriate number of bleed air inlet holes 10 for admitting air into the fuel well 9 and an appropriate number of small holes 11 of sub-nozzles for delivering fuel from the fuel well 9 are provided on the circumference of the inner core 7. For very small air flow, the mixture flow comes mostly from the sub-nozzles. In this case if the depth of the fuel well is too small, the distribution of fuel to all of the sub-nozzles becomes imcomplete, and large amount of fuel flow occurs inevitably at the sub-nozzles near the main passage. When the depth of the well is large, it acts as a damper between the main nozzle and the sub-nozzles, so that the distribution of fuel to the sub-nozzles is improved, and accordingly it brings a favorable effect on the distribution to the engine.

Being thus constructed, the fuel which has passed through the main fuel passage 5 once flows into the annular fuel well 9, and there is mixed with air coming from a bleed air inlet hole 10. The fuel is atomized and the atomized fuel flows out of the main nozzle 8 to the inner venturi 3. Accordingly, when the fuel which has already bled comes into the fuel well, it is bled further to promote the atomization, and since the period when the fuel flows out of the sub-nozzles 11 is earlier than the period when the fuel flows out of the main nozzle 8 (since the negative suction pressure of the engine applied on the main nozzle 8 and the sub-nozzle 11 are considered to be substantially the same, the fuel of the sub-nozzles 11 jets earlier than the main nozzle 8 which is nearer to the inlet 10 of the breed air), thus, by selecting the size and number of the sub-nozzles 11 and the bleed air inlet holes 100 appropriately, it is possible to regulate, to a certain extent, the initial jetting period of fuel of the main system. Furthermore, by providing the sub-nozzles 11 unevenly on the circumference, the jet direction can be changed, so that the distribution performance can be regulated substantially perfectly in cooperation with the mentioned adjustment of the position of the main nozzle.

Embodiments of the inner venturi, in particular the inner core according to the present invention will now be explained referring to the drawings.

In FIGS. 3 and 4, the numeral 12 shows a bridge member, which is arranged above the nozzle outlet of the inner core 7, and moreover, traverses said inner core. Further, in the drawing, said bridge member is formed integral with the inner core, but a single bridge member may also be used by bonding it to the inner core with adhesive. When such an inner core constituted as above is used instead of the inner core shown in FIG. 2 to constitute the inner venturi, the fuel jetted from the main nozzle 8 causes a vortex flow by said bridge member, which promotes the atomization further.

FIG. 5 shows another form of the inner core, in which a bar member 13 is disposed substantially at right angles to the direction of entering air, and the bar member 13 is so arranged that its free end is inserted in a free state into the main nozzle. Being thus arranged, by constituting the inner venturi using such an inner core as before, the fuel jetted from the main nozzle is introduced along the lower side of the bar member 13, so that it becomes possible to improve the fuel distribution in the suction passage within the inner venturi. To improve the fuel distribution further, it is preferable to dispose the free end of the bar member at the lower side in the space of the main nozzle.

FIG. 6 shows still another embodiment of the inner core, which has a construction such that the bridge member 12 and the bar member 13 shown in FIG. 4 and FIG. 5 are combined together. With such a combination, it is possible to promote the atomization of fuel and sufficient improvement in distribution of fuel.

FIG. 7 is a plan view showing a construction in which a plurality of main nozzles (8, 8′, 8″, 8‴) are arranged. This arrangement is also effective for the promotion of atomization and for improvement of distribution performance.

As stated above, according to the present invention, it is possible to promote the fuel atomization and the regulation of starting time of the fuel jetting, and also to improve the distribution performance, etc.

What is claimed is:

1. An inner venturi for a venturi type fixed carburetor comprising: an outer core member having a main fuel passage extending through a wall thereof, an inner core member defining a fuel-air-mixture inner venturi passageway and having at least one main nozzle extending through a wall thereof and opening at one end thereof directly into said fuel-air-mixture venturi passageway, said inner core member being mounted within said outer core member and defining an elongated annular fuel well between the outer wall of said inner core member and the inner wall of said outer core member, said well extending substantially the fuel axial length of said core members, said at least one main nozzle opening into said fuel well, said inner and outer core members closing off said fuel well at the top and bottom thereof, and circumferentially spaced bleeder holes extending vertically through at least one of said core members at the top of said fuel well and small-diameter circumferentially spaced sub-nozzles extending vertically through at least one of said core members at the bottom thereof.

2. The apparatus of claim 1, further comprising a bridge member disposed above, spaced from and parallel with said at least one main nozzle and extending across the inner core member fuel-air-mixture venturi passageway to produce a vortex flow below said bridge member and near the outlet of said at least one main nozzle of said inner core member.

3. The apparatus claimed in claim 2, wherein said bridge member is formed integral with the inner core member.

4. The apparatus of claim 1, further comprising a bar member disposed in said inner core member fuel-air-mixture venturi passageway at substantially right angles to the direction of entering air, said bar member being fixed at one end to one side of said inner core member and extending in cantilever fashion across said passageway and having the other, free end fitted loosely within the main nozzle opening in said inner core member.

5. The apparatus of claim 4 further comprising a bridge member formed integral with said inner core member and disposed above and in parallel with said main nozzle and extending across said inner core member fuel-air-mixture verturi passageway to produce a vortex flow near the outlet of said at least one main nozzle opening in said inner core member.

6. The apparatus of claim 1 wherein said main nozzles are plural in number in said inner core member, each communicating with said fuel well and with said main fuel passage.

7. The apparatus of claim 1, wherein said bleeder holes and said sub-nozzles are circumferentially offset from each other.

* * * * *